US005379628A

United States Patent [19]

Pahnke et al.

[11] Patent Number: 5,379,628

[45] Date of Patent: Jan. 10, 1995

[54] DRIVE FOR SHIFTING THE STROKE POSITION OF FORMING MACHINES

[75] Inventors: Michael Pahnke, Düsseldorf; Walter Westermeyer, Neuss, both of Germany

[73] Assignee: Pahnke Engineering GmbH & Co. KG, Dusseldorf, Germany

[21] Appl. No.: 11,434

[22] Filed: Jan. 29, 1993

[30] Foreign Application Priority Data

Mar. 31, 1992 [DE] Germany ..... 4210504

[51] Int. Cl.[6] ..... B21J 7/28

[52] U.S. Cl. ..... 72/453.18; 72/453.01; 100/269 R

[58] Field of Search ..... 72/453.13, 453.18, 453.01, 72/453.09, 455; 100/269 R

[56] References Cited

U.S. PATENT DOCUMENTS 3,158,046 11/1964 Steinfort et al. ..... 72/453.18

FOREIGN PATENT DOCUMENTS 1241068 8/1960 France ..... 72/453.18
0659904 5/1938 Germany ..... 73/453.18
15090 6/1956 Germany ..... 72/453.18
2022812 11/1971 Germany ..... 72/453.18
2223431 11/1972 Germany ..... 72/453.18
0621870 6/1961 Italy ..... 72/453.18

*Primary Examiner*—David Jones
*Attorney, Agent, or Firm*—Anderson Kill Olick & Oshinsky

[57] ABSTRACT

A method of controlling the drive of a forming machine, in particular of a hydraulic press or hydraulically driven forging machine, having at least one pump cylinder actuated by a crank-type driving mechanism and having return cylinders subjected to constantly rechargeable accumulator pressure, makes simple stroke position shifting and longer overall strokes possible by shutting off the supply of pressure medium to the return cylinders after a working stroke, whereby the return stroke is prevented from occurring and pressure fluid is sucked from the low pressure container into the working cylinder of the forming machine, and only turning the supply of pressure medium to the return cylinders on again for a new working stroke. In a drive of a forming machine the working cylinder of the forming machine is connected to the pump cylinder through a line that is connected via a first controlled check valve to a low pressure container, and a second controlled check valve is fitted in a line connecting the return cylinders with the fluid accumulator or the low pressure container.

7 Claims, 4 Drawing Sheets

DRIVE FOR SHIFTING THE STROKE POSITION OF FORMING MACHINES

TECHNICAL FIELD OF THE INVENTION

The invention relates to a drive for forming machines, in particular hydraulic presses or hydraulically driven forging machines, comprising at least one press cylinder actuated by a crank-type driving mechanism and return cylinders subjected to constantly rechargeable accumulator pressure, and a method of controlling said drive.

BACKGROUND OF THE INVENTION AND PRIOR ART

In hydraulic presses or forging machines having a hydraulic drive that operate with so-called crank-type driving mechanisms, such as is known for a forging machine e.g. from German patent 36 07 737, a single-cylinder crank pump drives a press cylinder using a pressure multiplying effect that corresponds to the ratio of the cylinder areas and a sinusoidal stroke movement the amplitude of which is in inverse proportion to the cylinder areas. The stroke frequency is determined by the speed of rotation of the pump drive. A quantity of fluid moved back and forth by the crank-type driving mechanism acts on the press cylinder so that this passes on to the press piston a pendulum or up-and-down movement in time with the crank-type driving mechanism. These drives enable extraordinarily high stroke rates to be achieved.

From DE-AS 12 54 433 a means of controlling the stroke movement of an upper tool holder of an electro-hydraulic hammer forging press having a crank-type drive is known that makes it possible to shift the position of the working stroke upwards and downwards to adapt it to the predetermined size of the body being forged by letting out part of the operating pressure medium or supplying it from an accumulator and thus reducing or increasing the volume of fluid that flows back and forth. In order to supply or eject pressure medium during the working stroke in the amount required in the event of a change in forging resistance a stroke position overlapping the body being forged is used and, by means of an additional inlet and outlet valve, the working stroke is interrupted on reaching the forging body by draining out pressure medium and the starting point of the working stroke is reset by letting in the same amount of pressure medium shortly before the upper turning point.

To enable the force of the press to be applied at all times during the whole stroke of the cylinder, expensive servo valves are required to introduce the pressure medium fluid into or remove it from the connecting line between the pump or pumps of the crank-type drive and the press cylinder so as to displace the stroke position of the press cylinder. Apart from the cost involved, the additional quantity of pressure medium can only be introduced in the pressureless phase during the return movement of the press, since otherwise large amounts of power would be needed, so that only correspondingly small changes in stroke are possible. However, for working procedures that require relatively long working strokes such small changes in stroke are inadequate.

OBJECT OF THE INVENTION

It is an object of the invention to provide a method of controlling the drive of a forming machine, and a drive of the kind in question, that make shifting the stroke position and longer overall strokes possible by simpler means.

SUMMARY OF THE INVENTION

To achieve this object in the case of a method for controlling the drive of a forming machine, after a working stroke the supply of pressure medium to the return cylinders is shut off so that the return stroke is prevented from taking place and pressure fluid is sucked out of the low pressure container into the working cylinder of the forming machine, and only for a new working stroke is the supply of pressure medium to the return cylinders turned on again. By thus—after the end of the working stroke—shutting off the supply of pressure medium to the return cylinders and simultaneously supplying the main driving cylinder with an additional quantity of pressure medium the desired displacement of the stroke position can be achieved. If simultaneously with the beginning of a new working stroke the return cylinders are then again supplied with pressure fluid, the forming machine starts the new stroke from the shifted position, and consequently this stroke position is also maintained.

To achieve the object in the case of a drive, the working cylinder of the forming machine is connected to the press cylinder via a line that is connected via a first controlled check valve to a low pressure container, and a second controlled check valve is fitted in a line connecting the return cylinders to the fluid accumulator or the low pressure container. A system is thus provided that enables short crank strokes with the stroke rate of the system to be strung together to longer working strokes. In it stroke shifting is thus possible without a separate servo valve, and within one stroke period a stroke position displacement of a whole stroke length can be achieved. All that need be done is to change over the second, controlled check valve so that a return stroke of the forming machine is prevented. The pump then sucks pressure fluid out of the low pressure container through the first controlled check valve, and the press begins the next working stroke, delayed by half a stroke period, one stroke length deeper. If at this moment the second check valve is again opened, the forming machine or the ram maintains the new stroke position.

According to one embodiment of the invention the return cylinders are fitted with plunger pistons and the working spaces are connected to the fluid accumulator by way of the line with the second check valve in it. In a second embodiment the return cylinders are fitted with differential pistons and the main working space (on the piston crown side) is connected to the fluid accumulator and the annular space (on the piston rod side) is connected to the low pressure container by way of the line with the second check valve in it. In both cases by opening the second check valve with the working spaces of the plunger piston version, or the annular spaces of the return cylinders in the case of the differential pistons, being connected to the accumulator or to the low pressure container respectively and with the first check valve being simultaneously closed, the working volume can be made to flow back and forth between the working cylinder of the forming machine and the press cylinder. At the same time the return stroke volumes flow back and forth, in the case of the first embodiment between the working spaces of the return cylinders and the fluid accumulator or in the case of the second embodiment between the main working spaces below the differential pistons of the return cylinders and the fluid accumulator, and also the annular space volumes between the annular spaces of the return cylinders and the low pressure container; in both cases the forming machine executes sinusoidal working strokes.

If in the case of the first embodiment a servo valve fed with pressure fluid from an auxiliary unit is connected to the line connected to the return cylinders, a fine adjustment in the shifting of the stroke position can be achieved. By means of the pressure fluid supplied to the servo valve, e.g. by a hydraulic pump, and introduced into the return stroke circuit, or removed from the return stroke circuit, the starting position for the next down- or up-stroke can be displaced during the standstill phase, thus making possible a slight change in the bottom dead center position.

Compared with feeding into the pipeline connected to the main working cylinder there is the advantage that the servo valve can be smaller by the ratio of the areas of the main and return cylinders, and only has to be designed for the maximum return pressure, which in general is lower than the working pressure in the main cylinder.

It is advisable in the case of the second embodiment for the check valve to be a controlled multiway valve that makes it possible either to connect the annular spaces of the return cylinders provided with differential pistons to the low pressure container or to shut off the pressure medium connection to the low pressure container. The open passage to the low pressure container is required for the working stroke and the shutting off for the stroke position shifting.

The permissible maximum pressure can be restricted by a safety valve, advantageously associated with the pump cylinder.

BRIEF DESCRIPTION OF THE DRAWINGS

The invention will now be described in more detail by way of example in relation to a forging press, with reference to embodiments shown diagrammatically in the drawings, in which.

DETAILED DESCRIPTION OF PREFERRED EMBODIMENTS OF THE INVENTION

Figure 1:
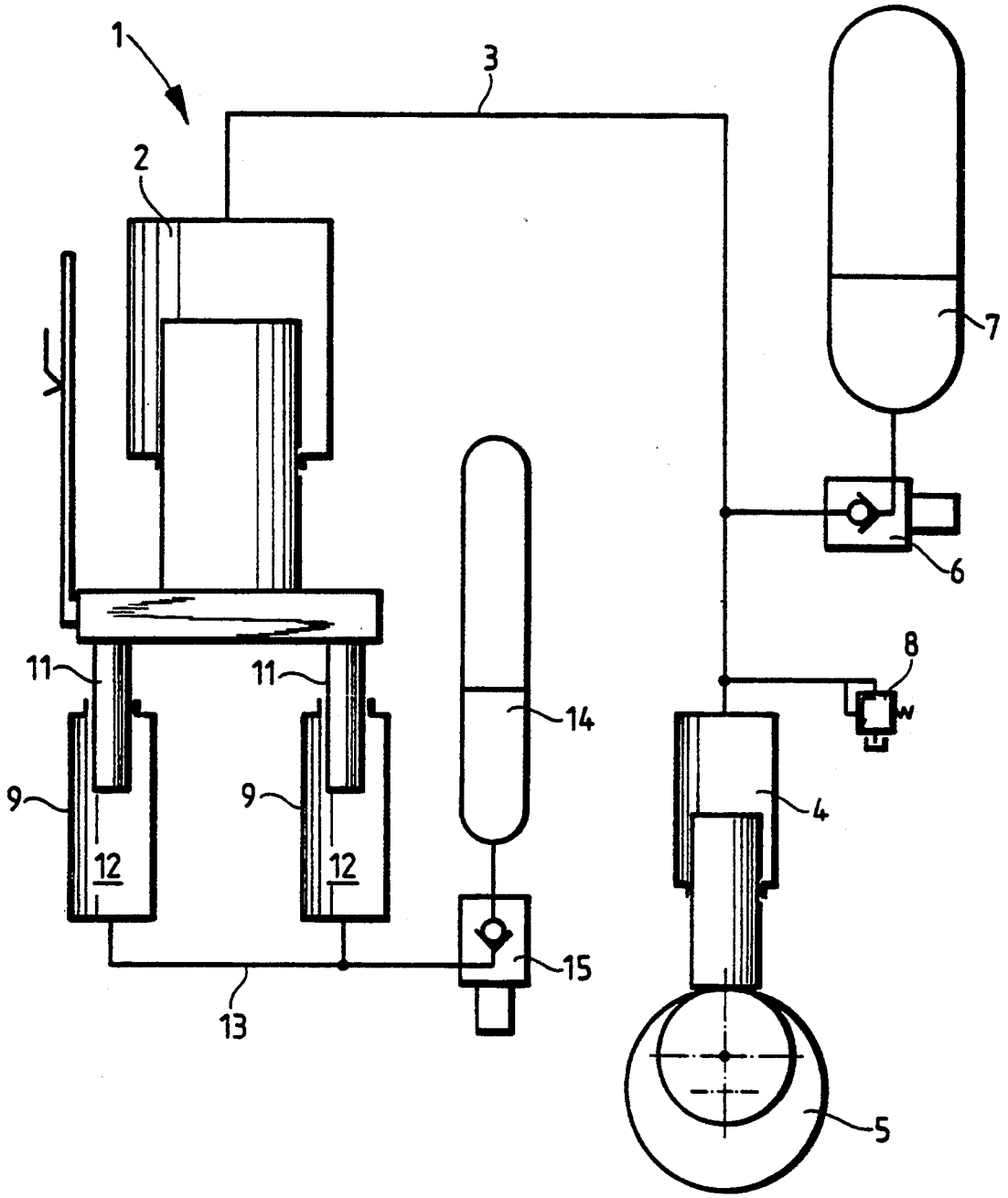
FIG. 1 is a diagrammatic drawing of a drive according to the invention for a forging press having return cylinders with plunger pistons.

In a forging press 1 that is known per se and is therefore not illustrated in detail a working cylinder 2 is connected via a line 3 to a pump cylinder 4 of a crank-type driving mechanism 5 that is usually driven by an electric motor via gears and a crank and can be engaged and disengaged. A low pressure container 7 is connected to the pipeline 3 via a first controlled check valve 6. A safety valve 8 associated with the pump cylinder 4 in the line 3 limits the permissible maximum pressure; from the pump cylinder 4 driving power for the upwardly and downwardly moveable ram (not shown) of the forging press 1 is applied via the crank-type driving mechanism 5.

The two return cylinders 9 that serve to return the ram of the forging press 1 to its starting position are provided, as shown in FIG. 1, with plunger pistons 11, and the working spaces 12 of the return cylinders 9 that produce the return forces are connected via a line 13 with a fluid accumulator 14; in the line 13 there is a second controlled check valve 15.

With the drive system shown in FIG. 1 the working cycle of standstill, working stroke and downward or upward shift in stroke position can be obtained. When the forging press 1 is at a standstill, i.e. when the ram is in the rest position and is not performing any upward or downward movement, only the first check valve 6 is opened and the second check valve 15 is closed. The press ram is held in position by the quantity of fluid enclosed in the working spaces 12 of the return cylinders 9, since the pressure fluid delivered from the press cylinder 4 with the cam or crank drive 5 flows back and forth through the open first check valve 6 and the low pressure container 7.

Figure 3:
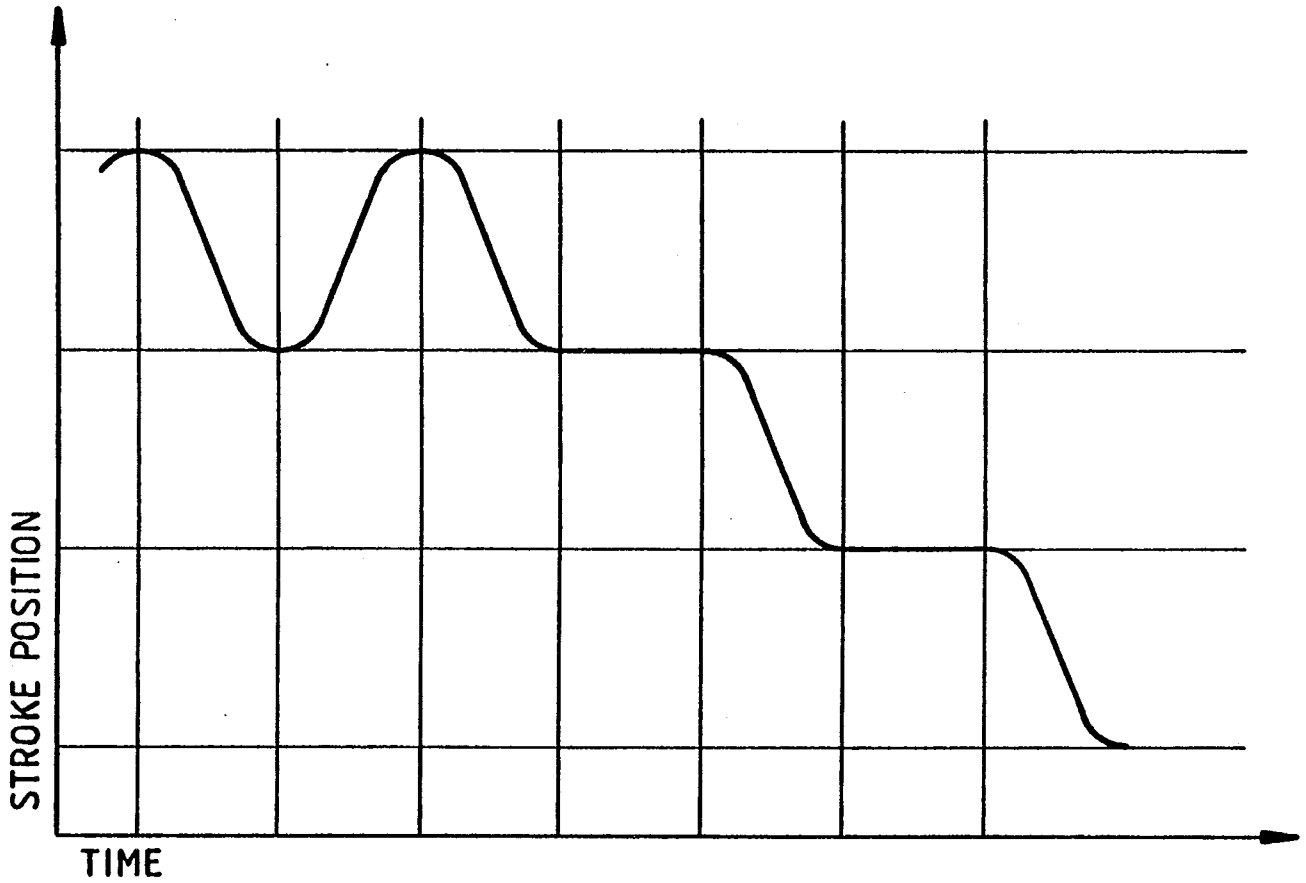
FIG. 3 is a motion chart showing the changes in stroke position that can be achieved with the drive systems shown in FIG. 1 and FIG. 2.

In order to perform the working stroke the second check valve 15 in the line 13 is opened, so that the working spaces 12 of the return cylinders 9 are connected to the fluid accumulator 14, while simultaneously the first check valve fitted in the connection between the line 3 and the low pressure container 7 closes. The quantity of fluid effecting the working stroke now flows back and forth between the working cylinder 2 of the forging press 1 and the press cylinder 4 acted on by the crank-type driving mechanism 5 and the quantity of fluid effecting the return stroke flows back and forth between the working spaces 12 of the return cylinders 9 and the fluid accumulator 14. When the valves 6 and 15 are controlled in this way the press or the press ram performs sinusoidal working strokes (cf. the motion curve at the top left of FIG. 3).

To shift the position of the press or ram stroke downwards by a full working stroke the second check valve 15 fitted between the working spaces 12 of the return cylinders 9 and the fluid accumulator 14 is changed over, either at the top dead center of the stroke of the press cylinder 4 or—which is the same in point of time—at the bottom dead center of the press stroke; since the working spaces 12 are then no longer fed from the fluid accumulator 14 the press is prevented from carrying out its return stroke. Instead, the press cylinder 4 sucks pressure fluid out of the low pressure container 7 through the first check valve 6, with the result that the press starts its next working stroke delayed by half the period of a stroke and one stroke length deeper, as is shown in the motion diagram in FIG. 3. It then only needs the second check valve 15 associated with the return cylinders 9 to be opened again to ensure that the press subsequently maintains the new stroke position. If the stroke position is to be shifted upwards, the first check valve 6 is also opened while the second check valve 15 is open, i.e. the press cylinder 4 is connected to the low pressure container 7. Through the force acting from the fluid accumulator 14 into the working spaces 12 of the return cylinders 9 and on the crowns of the plunger pistons 11 the working stroke of the press is displaced upwards.

Figure 4:
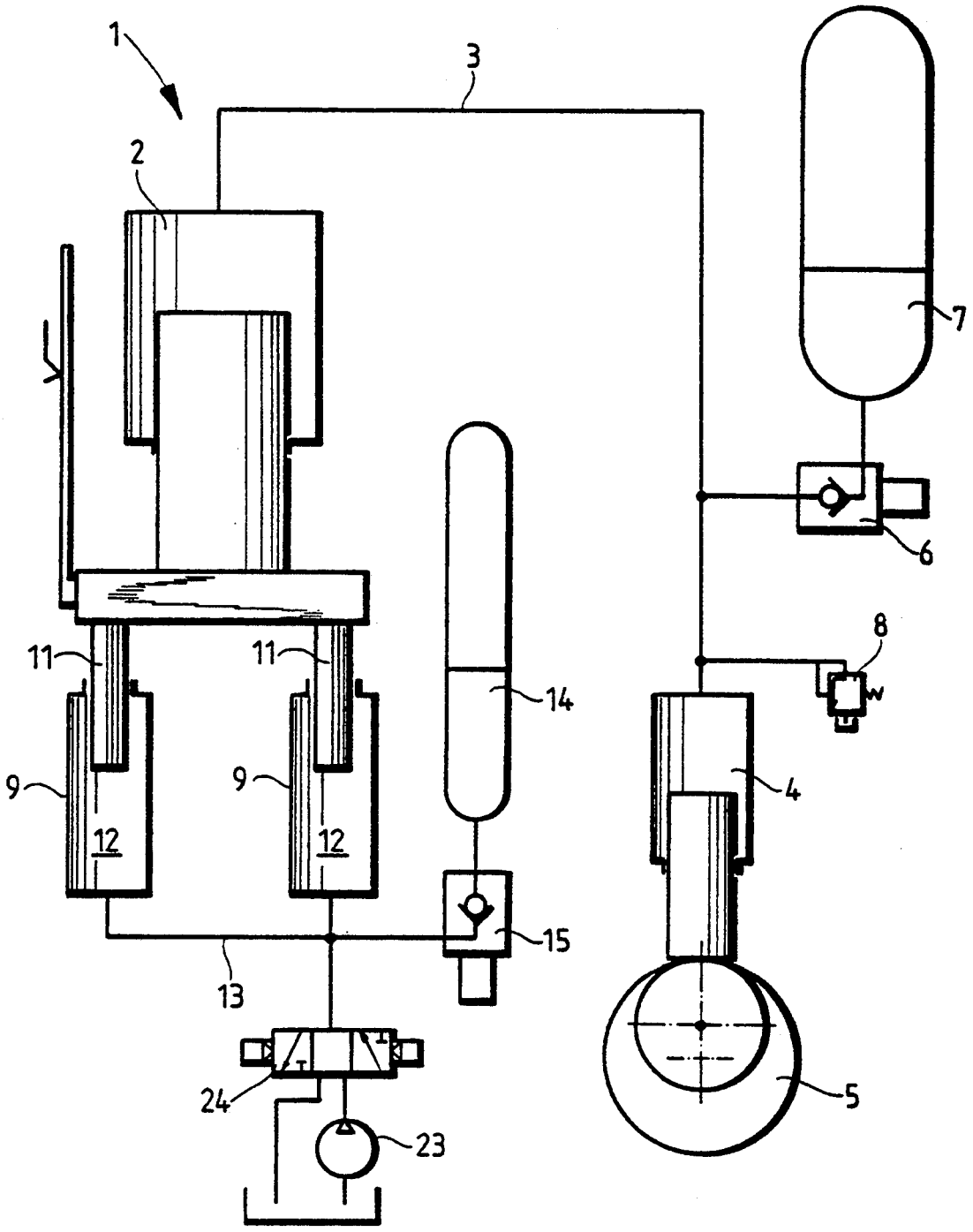
FIG. 4 is a diagrammatic drawing of a modified embodiment of the drive shown in FIG. 1.

The drive shown in FIG. 4 is to a very large extent identical with the embodiment shown in FIG. 1, so that in FIG. 4 the same reference numerals are used for similar parts. In addition in this embodiment a servo valve 24 fed from an auxiliary unit in the form of a hydraulic pump is fitted in the return circuit and connected to the line 13 connecting the working spaces 12 of the two return cylinders 9 to the fluid accumulator 14. By feeding pressure fluid to or withdrawing it from the return cylinders 9 the starting position for the next down or up stroke can be sensitively adjusted during the standstill phase of the forging press 1.

Figure 2:
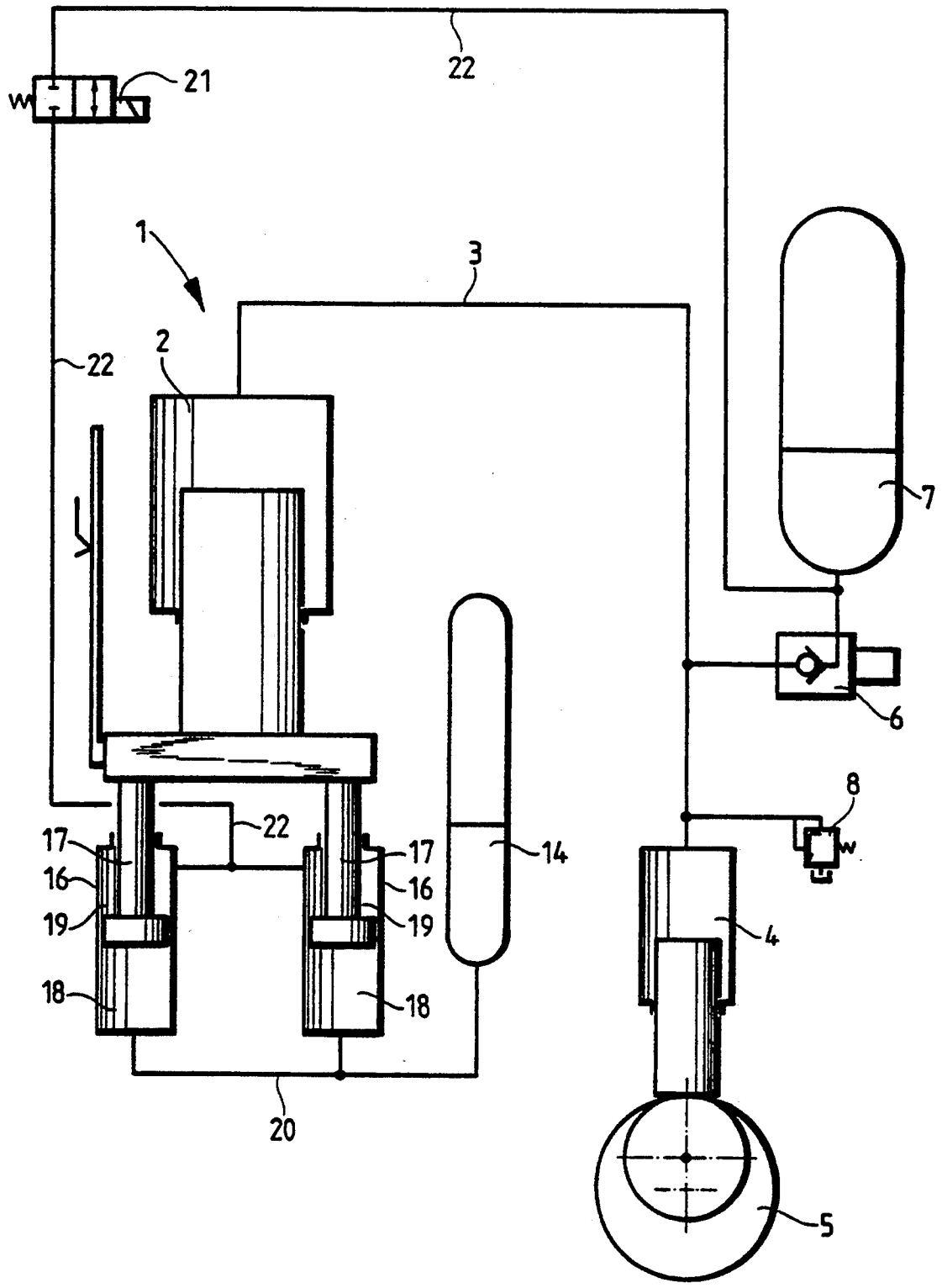
FIG. 2 is a diagrammatic drawing of a drive according to the invention for a forging press having return cylinders with differential pistons.

The modified embodiment of a drive for the forging press 1 shown in FIG. 2 differs from the embodiment shown in FIG. 1 by a different construction of the return cylinders 16 and of the second controlled check valve and in the way it is arranged; similar parts are otherwise provided with the same reference numerals as in FIG. 1. The return cylinders 16 have differential pistons 17 that divide the cylinder space into a main working space 18 on the piston crown side and an annular space 19 on the piston rod side. The main working spaces 18 are connected to the fluid accumulator 14 by a line 20, which in this case has no check valve in it; instead the second check valve, in the form of a multiway valve 21, is fitted in a line 22 that connects the annular spaces 19 of the return cylinders 16 with the low pressure container 7.

With the drive shown in FIG. 2 the same sequence of operations as with the embodiment shown in FIG. 1, i.e. standstill, working stroke and downward or upward shifting of the stroke can be followed. When the press is at a standstill the multiway valve 21 is in the blocking position shown in FIG. 2, while the check valve 6 is opened. The pressure fluid is thus enclosed in or over the annular spaces 19 of the return cylinders 16 and the press or the press ram is held fast in position, while the fluid delivered from the press cylinder 4 by the crank-type driving mechanism 5 flows back and forth through the opened check valve 6 between the press cylinder 4 and the low pressure container 7. For the working stroke the multiway valve 21 is switched to the left from the right hand position shown in the drawing, so as to give a free passage from the annular spaces 19 to the low pressure container 7, while simultaneously the check valve 6 is closed. The quantity of pressure medium serving for the working stroke thus flows back and forth between the working cylinder 2 of the forging press 1 and the press cylinder 4, while the quantity of pressure medium effecting the return flows between the main working spaces 18 of the return cylinders 16 and the fluid accumulator 14 and the quantity of pressure medium in or above the annular spaces 19 flows between the annular spaces 19 and the low pressure container 7. In this case, too, the press or the press ram performs sinusoidal working strokes.

A shift in the stroke position by a full working stroke downwards is obtained if in the top dead center of the stroke of the press cylinder 4 or in the bottom dead center of the stroke of the press the multiway valve 21 is changed over from the working stroke control position back into the position shown in FIG. 2; the press is then prevented from carrying out its return stroke. Instead, the press or the pump cylinder 4 sucks pressure fluid out of the low pressure container 7, so that the press begins its next working Stroke delayed by half a stroke period and one stroke length deeper (cf. the motion diagram shown in FIG. 3). In order to maintain this stroke length the multiway valve 21 is at the same moment changed back again from right to left and thereby switched back to free passage from the annular-spaces 19 of the return cylinders 16 to the low pressure container 7. If from this controlled position of the multiway valve 21 the first check valve 6 is then opened, the working stroke of the press or of the press ram is displaced upwards through the force acting from the fluid accumulator 14 on the piston faces of the differential pistons 17.

Both embodiments thus make it possible to achieve a shift in stroke position without a separate servo valve and, through stringing together short crank strokes (cf. FIG. 3) with the stroke frequency of the system, to get longer overall strokes, and to achieve a shift in the stroke position of a whole stroke length within one stroke period.

What is claimed is:

1. A method of operating a hydraulic press including a ram, a working cylinder for effecting a downward, working stroke of the ram, and return cylinder means for effecting an upward return stroke of the ram, said method comprising the steps of:

providing a drive, including a press cylinder for imparting motion to the working cylinder, a crank drive for operating the press cylinder, a low pressure container communicating with the press cylinder, first fluid line means communicating the press cylinder with the working cylinder, second fluid line means communicating the low pressure container with the press cylinder, a first check valve located in the second fluid line means and having an open position, in which fluid flows between the press cylinder and the low pressure container, and a closed position, in which fluid flows between the working and press cylinders, a fluid accumulator, third fluid line means communicating the return cylinder means with the fluid accumulator, and a second check valve located in the third fluid flow line means and having an open position in which the return cylinder means communicates with the fluid accumulator, and a closed position, in which pressure in the return cylinder means remains constant;

closing the first check valve for enabling fluid flow between the press and working cylinders in accordance with operation of the crank drive, and opening the second check valve for enabling fluid flow between the return cylinder means and the fluid accumulator to thereby provide for operation of the press with a first working stroke displacement;

shifting the operation of the press with the first working stroke displacement to an operation with a second stroke displacement by changing over the second check valve at one of top and bottom dead centers of the working stroke, whereby a return stroke is prevented due to blocking fluid flow from the fluid accumulator to the return cylinder means while pressure fluid is aspirated from the low pressure container through the first check valve into the press cylinder, so that the press starts the operation with the second stroke displacement, which is delayed by half of a stroke period and which has a displacement length double that of a displacement length of the first stroke displacement; and thereafter, again opening the second check valve to enable a continuous operation of the press with the second working stroke.

2. A drive for a hydraulic press having a ram, a working cylinder for effecting a downward, working stroke of the ram, and a return cylinder means for effecting an upward return stroke of the ram, said drive comprising:

a press cylinder for imparting motion to the working cylinder;

a crank drive for operating the press cylinder;

a low pressure container communicating with the press cylinder;

first fluid line means communicating the press cylinder with the working cylinder;

second fluid line means communicating the low pressure container with the press cylinder;

a first check valve located in the second fluid line means and having an open position in which fluid flows between the press cylinder and the low pressure container, and a closed position, in which fluid flows between the working and press cylinders;

fluid accumulator;

third fluid line means communicating the return cylinder means with the fluid accumulator; and a second check valve located in the third fluid line means and having an open position, in which the return cylinder means communicates with the fluid accumulator and a closed position, in which pressure in the return cylinder means remains constant.

3. A drive according to claim 2, wherein the return cylinder means comprises two hydraulic cylinder units each having a cylinder, a piston displaceable in the cylinder, and a rod connecting the piston with the ram, the cylinder having a working fluid space located on a crown side of the piston and communicating with the fluid accumulator.

4. A drive according to claim 2, further comprising a safety valve for limiting pressure applied to the working cylinder.

5. A drive for a hydraulic press having a ram, a working cylinder for effecting a downward, working stroke of the ram, and a return cylinder means for effecting an upward return stroke of the ram, said drive comprising:

a press cylinder for imparting motion to the working cylinder;

a crank drive for operating the press cylinder;

a low pressure container communicating with the press cylinder;

first fluid line means communicating the press cylinder with the working cylinder;

second fluid line means communicating the low pressure container with the press cylinder;

a first check valve located in the second fluid line means and having an open position, in which fluid flows between the press cylinder and the low pressure container, and a closed position, in which fluid flows between the working and press cylinders;

fluid accumulator;

third fluid line means communicating the return cylinder means with the fluid accumulator; and a second check valve located in the third fluid line means and having an open position, in which the return cylinder means communicates with the fluid accumulator and a closed position, in which pressure in the return cylinder means remains constant;

an auxiliary fluid unit;

fourth fluid line means communicating the auxiliary unit with the third fluid line means; and a third check valve located in the fourth fluid line means.

6. A drive for a hydraulic press having a ram, a working cylinder for effecting a downward, working stroke of the ram, and a return cylinder means for effecting an upward return stroke of the ram, said drive comprising:

a press cylinder for imparting motion to the working cylinder;

a crank drive for operating the press cylinder;

a low pressure container communicating with the press cylinder;

first fluid line means communicating the press cylinder with the working cylinder;

second fluid line means communicating the low pressure container with the press cylinder;

a first check valve located in the second fluid line means and having an open position in which fluid flows between the press cylinder and the low pressure container, and a closed position, in which fluid flows between the working and press cylinders;

fluid accumulator;

third fluid line means communicating the return cylinder means with the fluid accumulator; and a second check valve located in the third fluid line means and having an open position, in which the return cylinder means communicates with the fluid accumulator and a closed position, in which pressure in the return cylinder means remains constant, wherein the return cylinder means comprises two hydraulic cylinder units each having a cylinder, a differential piston displaceable in the cylinder and a rod connecting the piston with the ram, the cylinder having a first fluid space located on a crown side of the piston and communicating with the fluid accumulator, and a second fluid space located on a rod side of the piston, and further wherein the hydraulic press comprises conduit means communicating the second fluid spaces of the cylinders of the two cylinder units with the low pressure container, the conduit means intersecting the second fluid line.

7. A drive for a hydraulic press having a ram, a working cylinder for effecting a downward, working stroke of the ram, and a return cylinder means for effecting an upward return stroke of the ram, said drive comprising:

a press cylinder for imparting motion to the working cylinder;

a crank drive for operating the press cylinder;

a low pressure container communicating with the press cylinder;

first fluid line means communicating the press cylinder with the working cylinder;

second fluid line means communicating the low pressure container with the press cylinder;

a first check valve located in the second fluid line means and having an open position in which fluid flows between the press cylinder and the low pressure container, and a closed position, in which fluid flows between the working and press cylinders;

fluid accumulator;

third fluid line means communicating the return cylinder means with the fluid accumulator; and a second check valve located in the third fluid line means and having an open position, in which the return cylinder means communicates with the fluid accumulator, and a closed position, in which pressure in the return cylinder means remains constant, wherein the second check valve is a controlled multiway valve.

* * * * *